US007523564B2

(12) United States Patent
Doh

(10) Patent No.: US 7,523,564 B2
(45) Date of Patent: Apr. 28, 2009

(54) DRYER AND DRUM SUPPORTING APPARATUS THEREOF

(75) Inventor: Young Jin Doh, Busan-si (KR)

(73) Assignee: LG Electronics Inc., Seoul (KR)

( * ) Notice: Subject to any disclaimer, the term of this patent is extended or adjusted under 35 U.S.C. 154(b) by 29 days.

(21) Appl. No.: 11/437,688

(22) Filed: May 22, 2006

(65) Prior Publication Data

US 2006/0260150 A1 Nov. 23, 2006

(30) Foreign Application Priority Data

May 23, 2005 (KR) ..... 10-2005-0042892
May 23, 2005 (KR) ..... 10-2005-0042895

(51) Int. Cl.
*F26B 11/02* (2006.01)
*D06F 58/00* (2006.01)

(52) U.S. Cl. ..... 34/601

(58) Field of Classification Search ..... 34/595, 34/601, 602, 603, 139, 108; 384/202, 286, 384/485, 504, 537
See application file for complete search history.

(56) References Cited

U.S. PATENT DOCUMENTS

| | | | | | |
|---|---|---|---|---|---|
| 1,722,488 | A * | 7/1929 | Bott et al. | 384/488 |
| 2,121,237 | A * | 6/1938 | Smith | 384/504 |
| 3,567,297 | A * | 3/1971 | Triplett et al. | 34/601 |
| 3,581,363 | A * | 6/1971 | Roesner et al. | 384/202 |
| 3,994,545 | A * | 11/1976 | Van Dorn | 384/482 |
| 4,458,957 | A * | 7/1984 | Greener | 384/538 |
| 5,483,756 | A * | 1/1996 | Heyder | 34/601 |
| 2005/0132604 | A1 * | 6/2005 | Hong et al. | 34/603 |

FOREIGN PATENT DOCUMENTS

EP 1 507 036 2/2005

OTHER PUBLICATIONS

German Office Action dated Nov. 13, 2008.

* cited by examiner

*Primary Examiner*—Jiping Lu
(74) *Attorney, Agent, or Firm*—Ked & Associates LLP

(57) ABSTRACT

A dryer is provided. The dryer includes a housing coupled to a rear wall of a drum, a housing cover, a bearing, and a supporting holder. The housing cover is coupled to the housing. The bearing is interposed between the housing and the housing cover. The supporting holder is interposed between the housing and the bearing.

13 Claims, 10 Drawing Sheets

DRYER AND DRUM SUPPORTING APPARATUS THEREOF

BACKGROUND OF THE INVENTION

1. Field of the Invention

The present invention relates to a dryer, and more particularly, to a drum supporting apparatus of a dryer that not only allows the drying drum to rotate within the cabinet of the dryer without any friction, but also supports the drum on a back cover to keep the drum horizontally disposed.

2. Description of the Related Art

Drum apparatuses in washing machines, dryers, and washing machines with a dryer function are apparatuses that utilize the rotation of the drum. That is, the drum is rotated so that laundry within is rotated and tumbled.

For example, drum-type washing machines raise and drop laundry, causing the laundry to collide with wash liquid so that impurities are removed from the laundry.

Also, in drum-type dryers, air heated by an electric heater or a gas burner is blown inside the drum to dry laundry within.

In detail, drum dryers are divided into condenser dryers that do not exhaust air to the outside, but circulate the air within the unit to dry laundry, and vented dryers that use air suctioned into the drum from the outside to dry laundry, after which the air is exhausted to the outside.

A drum dryer has a journal bearing connected to the rear of the drum and the cabinet, allowing the drum to rotate smoothly. Here, the journal bearing acts as the central point of the rotating drum, and is lubricated within to prevent it from overheating when the drum rotates.

However, in the case of journal bearings in condenser dryers according to the related art, despite being lubricated, the journal bearings are heated by friction from the rotation of the drum, and the lubricant inside the bearing is not distributed evenly.

Furthermore, the lubricant injected inside the bearing can leak out from the bearing to not only contaminate the rear of the drum, but also be unable to perform its lubricating function.

SUMMARY OF THE INVENTION

Accordingly, the present invention is directed to a dryer and a drum supporting apparatus thereof that substantially obviates one or more problems due to limitations and disadvantages of the related art.

An object of the present invention is to provide a dryer and a drum supporting apparatus thereof that support the drum and allow the drum to rotate smoothly without friction.

Another object of the present invention is to provide a dryer and a drum supporting apparatus thereof that prevent leakage of lubricant from a journal bearing to the outside and resulting contamination of the rear of the drum and failure of the lubricant to perform its function.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dryer including:

a housing coupled to a rear wall of a drum; a housing cover coupled to the housing; a bearing interposed between the housing and the housing cover; and a supporting holder interposed between the housing and the bearing.

In another aspect of the present invention, there is provided a drum supporting apparatus of a dryer including: a housing; a housing cover coupled to the housing; a bearing including a ball inserted between the housing and the housing cover and a shaft integrally extending from the ball; and a supporting holder against which a portion of an outer surface of the ball is pressed, wherein a portion of the supporting holder against which the portion of the ball is pressed is more smoothly finished than other portions of the supporting holder.

In a further aspect of the present invention, there is provided a drum supporting apparatus of a dryer including: a housing recessed a predetermined depth inward; a supporting holder including a recessed portion recessed in a same curvature as that of a recessed portion of the housing; a bearing mounted in the recessed portion of the supporting holder; a housing cover covering the housing and including a through-portion for a portion of the bearing to pass through; and a first sealing member inserted inside the through-portion.

The above-structured drum supporting apparatus of a dryer, according to the present invention, allows the drum to rotate smoothly, while preventing the occurrence of friction-induced heat within the bearing during a drying cycle.

Also, the drum supporting apparatus of a dryer according to the present invention prevents an anti-friction lubricant applied within the bearing housing from leaking to the outside.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Below, a condenser dryer with a drum supporting apparatus, according to preferred embodiments of the present invention, will be described.

Figure 1:
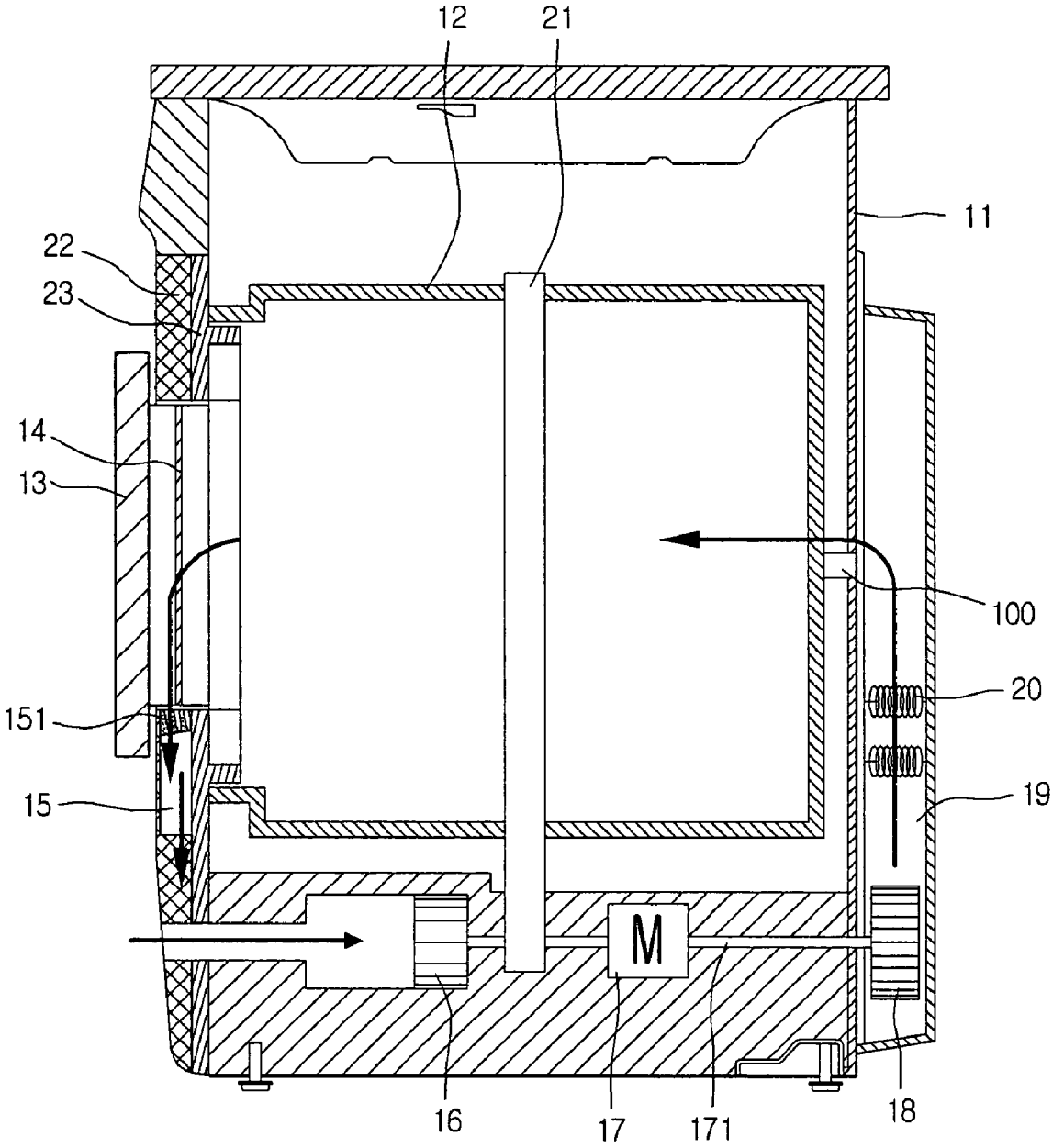
FIG. 1 is a sectional view of a dryer with a drum supporting apparatus according to the present invention.

FIG. 1 is a sectional view of a dryer with a drum supporting apparatus according to the present invention.

Referring to FIG. 1, a dryer 10, having a drum supporting apparatus according to the present invention, includes a cabinet 11 forming the outer structure of the dryer 10, a front frame 22 and a front cover 23 coupled at the front of the cabinet 11, a cylindrical drum 12 formed within the cabinet 11, a door 13 installed at the front of the drum 12 for opening and closing an entrance of the drum 12, a belt 21 wrapped around the outer circumference of the drum 12 to rotate the drum 12, and a drum supporting portion 100 for supporting the rear of the drum 12 on the cabinet 11. Here, the front portion of the drum 12 is supported by the front cover 23.

The dryer 10 also includes a motor shaft 171 connected to the belt 21, a motor 17 connected to the motor shaft 171 for imparting rotational force to the belt 21, and a cooling fan 16 connected to the motor shaft 171 for receiving rotational force from the motor 17 and rotating to suction indoor air.

The dryer 10 further includes a drying fan 18 connected to the motor shaft 171 on the side opposite to the cooling fan 16 to circulate air within the drum, and a drying duct 19 being a passage for air suctioned by the drying fan 18 to flow to the drum 12 and having a heating unit 20 installed within.

Additionally, the dryer 10 includes a door lint filter 14 formed at the rear of the door 13 to filter lint from moist air being discharged from the drum 12, a body lint filter 151 for re-filtering the moist air that has passed the door lint filter 14, and a circulating duct 15 being a passage for the air that passes through the body lint filter 151 flowing to a condenser (not shown).

The operation of the above dryer will now be described.

First, when power is applied to the dryer, the motor 17 rotates and the heater 20 installed within the drying duct 19 is heated. The belt 21 connected to the motor shaft 171 rotates to rotate the drum 12. In detail, the drum 12 rotates around the drum supporting portion 100 that acts as a rotating axis. The rotation of the drum 12 causes laundry to be dried within the drum 12 to rotate along the inner walls of the drum 12 until it reaches the highest point thereof, whereupon it drops due to gravity. Here, the laundry to be dried is raised on the inner walls of the drum 12 by lifters (not shown) on the inner walls.

The drying fan 18 connected to the motor shaft 171 rotates together with the motor 17 and suctions circulating air that passes through the condenser. The suctioned circulating air ascends along the drying duct 19, becoming hot and dry as it passes the heating unit 20. The hot, dry circulating air then passes through the inside of the drum 12, where it absorbs moisture from the laundry and becomes hot and moist.

The hot, moist air passes the door lint filter 14 and the body lint filter 151 and is filtered of impurities, after which it flows along the circulating duct 16 to the condenser.

The cooling fan 16 connected to the motor shaft 171 rotates and suctions indoor air from outside the dryer. The suctioned indoor air passes the cooling fan 16 and flows to the condenser.

Here, the hot, moist air that moves along the circulating duct 15 to the condenser and the indoor air suctioned by the cooling fan 16 toward the condenser intersect and bypass the condenser. The hot, moist air and the indoor air do not mix due to the configuration of the condenser, and exchange heat.

Accordingly, the hot, moist air loses heat to the indoor air as it passes the condenser to become cool, moist air. As the air cools, the moisture contained within it condenses to collect on the floor of the condenser, and flows to a sump (not shown) for collecting condensed water.

The moisture that moves to the sump (not shown) is moved by the sump to a condensed water storage (not shown) disposed at the top of the dryer.

The indoor air that passes the condenser is heated by the hot, moist air.

Figure 2:
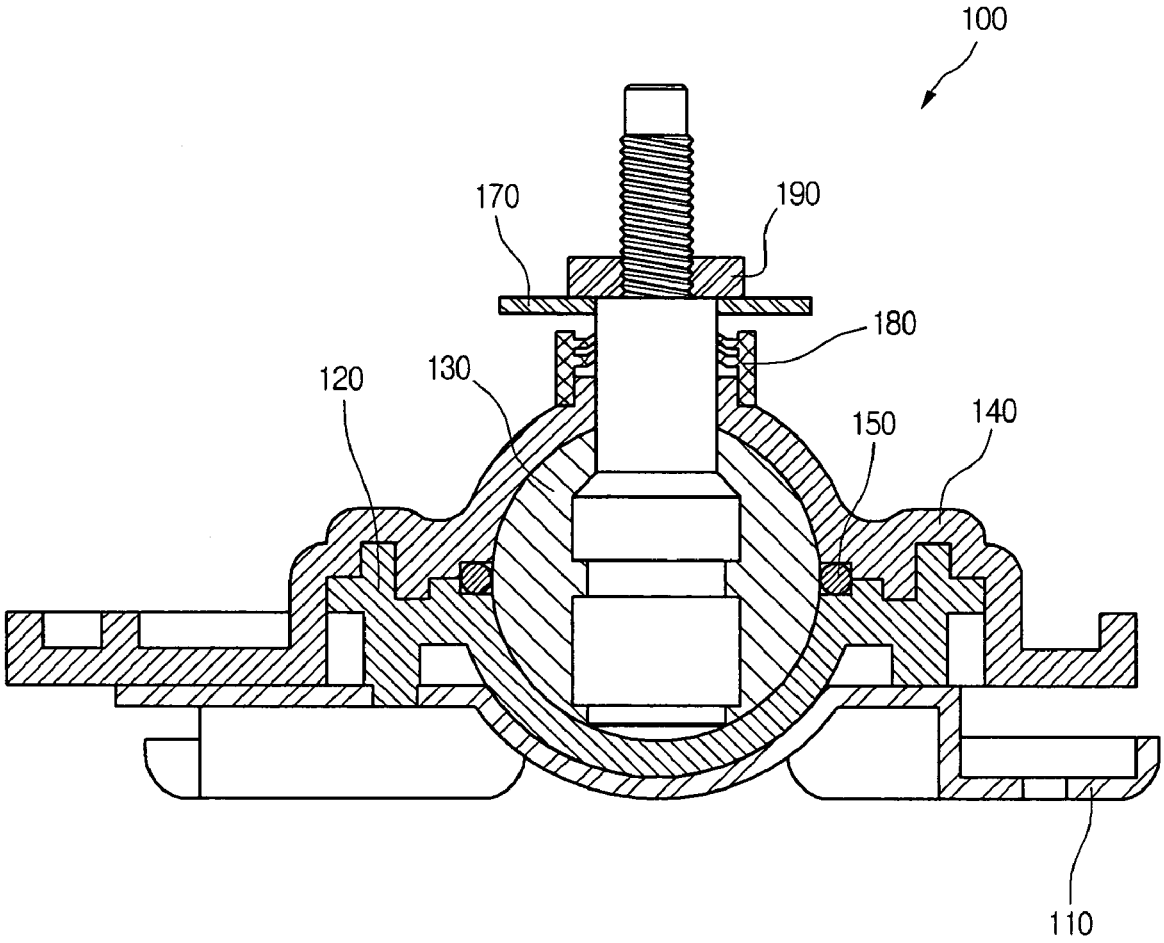
FIG. 2 is a sectional view of a drum supporting portion according to the present invention.

FIG. 2 is a sectional view of a drum supporting portion according to the present invention.

Referring to FIG. 2, the drum supporting portion 100, according to the present invention, is installed on the rear surface of the drum to support the rear wall of the drum and keep the drum horizontally disposed for a smooth rotation thereof.

In detail, the drum-supporting portion 100 includes a housing 110 installed at a rear surface of the drum (not shown), a housing cover 140 fastened to a front surface of the housing 110, a supporting holder 120 interposed between the housing 110 and the housing cover 140, a bearing 130 interposed between the supporting holder 120 and the housing cover 140, a sealing cap 180 covering the upper portion of the housing cover 140 to prevent leakage of lubricant injected in the outer perimeter of the bearing 130, a gasket 170 inserted over the shaft of the bearing 130, and a nut 190 inserted over the shaft and coupled to the upper end of the gasket 170.

In further detail, a back cover (not shown) of the dryer is disposed between the gasket 170 and the nut 190, to support one end of the drum supporting portion 100. In other words, the end of the bearing 130 passes through the back cover and the gasket 170 presses against the front surface of the back cover. The end of the bearing 130 has the nut 190 inserted thereover and tightened against the rear surface of the back cover.

In still further detail, the housing 110 is fixed and coupled to the rear surface of the drum through a fastening member. The supporting holder 120 is mounted on the upper surface of the housing 110, and a concaved portion is formed in the approximate center of the supporting holder 120 for the bearing 130 to be mounted therein. Lubricant is applied to the concaved portion, and the bearing 130 is mounted in the concaved portion. The housing cover 140 is mounted on top of the supporting holder 120 to cover the bearing 130. A sealing member 150 is inserted in the inner portion between the supporting holder 120 and the housing cover 140, to prevent leakage of lubricant through the gap between the supporting holder 120 and the housing cover 140. Here, the sealing member 150 may be an O-ring.

The above-structured drum supporting portion 100 is coupled to the rear surface of the drum and the back cover to maintain the drum in a horizontal disposition and allow it to rotate without friction.

Below, a description of the form and function of each component of the drum supporting portion 100 will be given, with reference to the diagrams.

Figure 3:
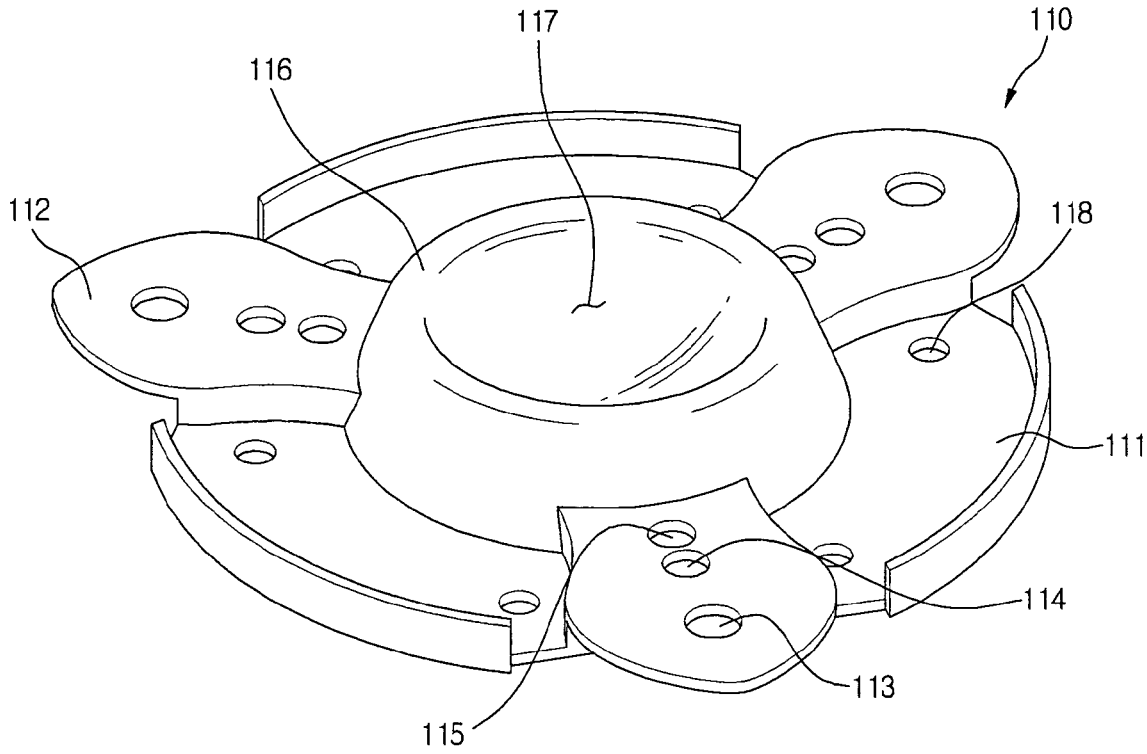
FIG. 3 is a perspective view of a housing for a drum supporting portion according to the present invention.

FIG. 3 is a perspective view of a housing for a drum supporting portion according to the present invention.

Referring to FIG. 3, the housing 110 of the drum supporting portion 100 according to the present invention includes a cylindrical drum mounting portion 111, a housing cover mounting portion 112 bent a predetermined height from the top of the drum mounting portion 111 for pressing against the housing cover 140, a ball supporting portion 116 protruding a predetermined diameter and height to the inside of the drum mounting portion 111, and a supporting holder mount 117 concaved a predetermined depth within the ball supporting portion 116 for mounting the bearing 130.

In detail, the housing cover mounting portion 112 includes a guide boss insert hole 115 of a predetermined size formed in an inner portion thereof, a preliminary fastening hole 114 formed a predetermined distance from the guide boss insert hole 115, and a housing cover fastening hole 113 formed a predetermined distance from the preliminary fastening hole 114. Also, a plurality of drum fastening holes 118 are formed in the drum mounting portion 111 at a predetermined distance from one another. In detail, a fastening protrusion 144 (in FIG. 5) is inserted in the preliminary fastening hole 114 to preliminarily fasten the housing cover 140 to the housing 110. A description of this fastening is given below with reference to the diagrams.

The above-structured housing 110 is installed on the rear surface of the drum using a fastening member. Specifically, a fastening member is inserted in the drum fastening hole 118 to fasten the rear surface of the drum to the housing 110. A mounting portion is formed on the rear surface of the drum to mount the housing 110.

The respective components fastened to the housing 110 will now be described with reference to the diagrams.

Figure 4:
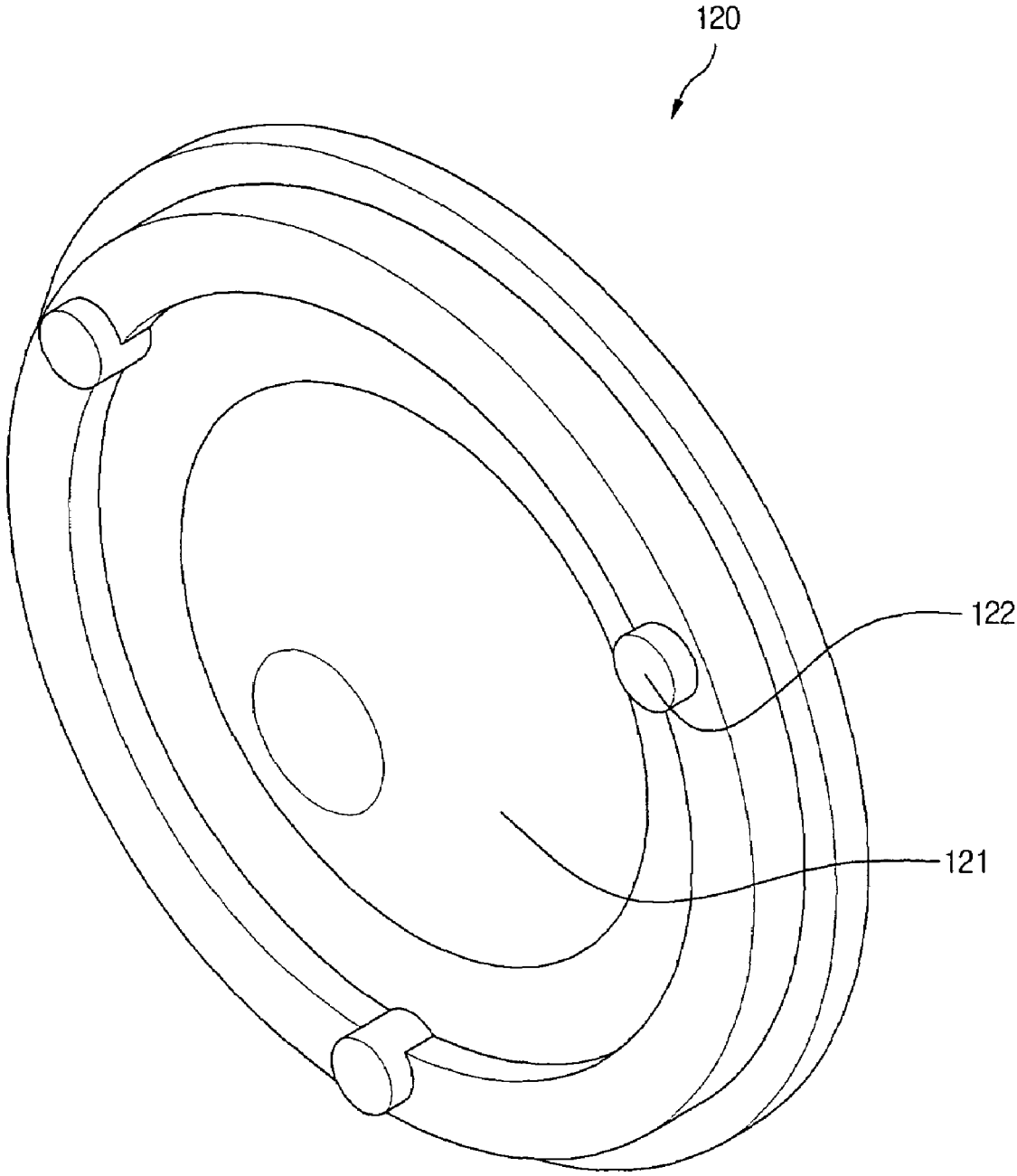
FIG. 4 is a rear perspective view of a supporting holder for a drum supporting portion according to the present invention.
Figure 5:
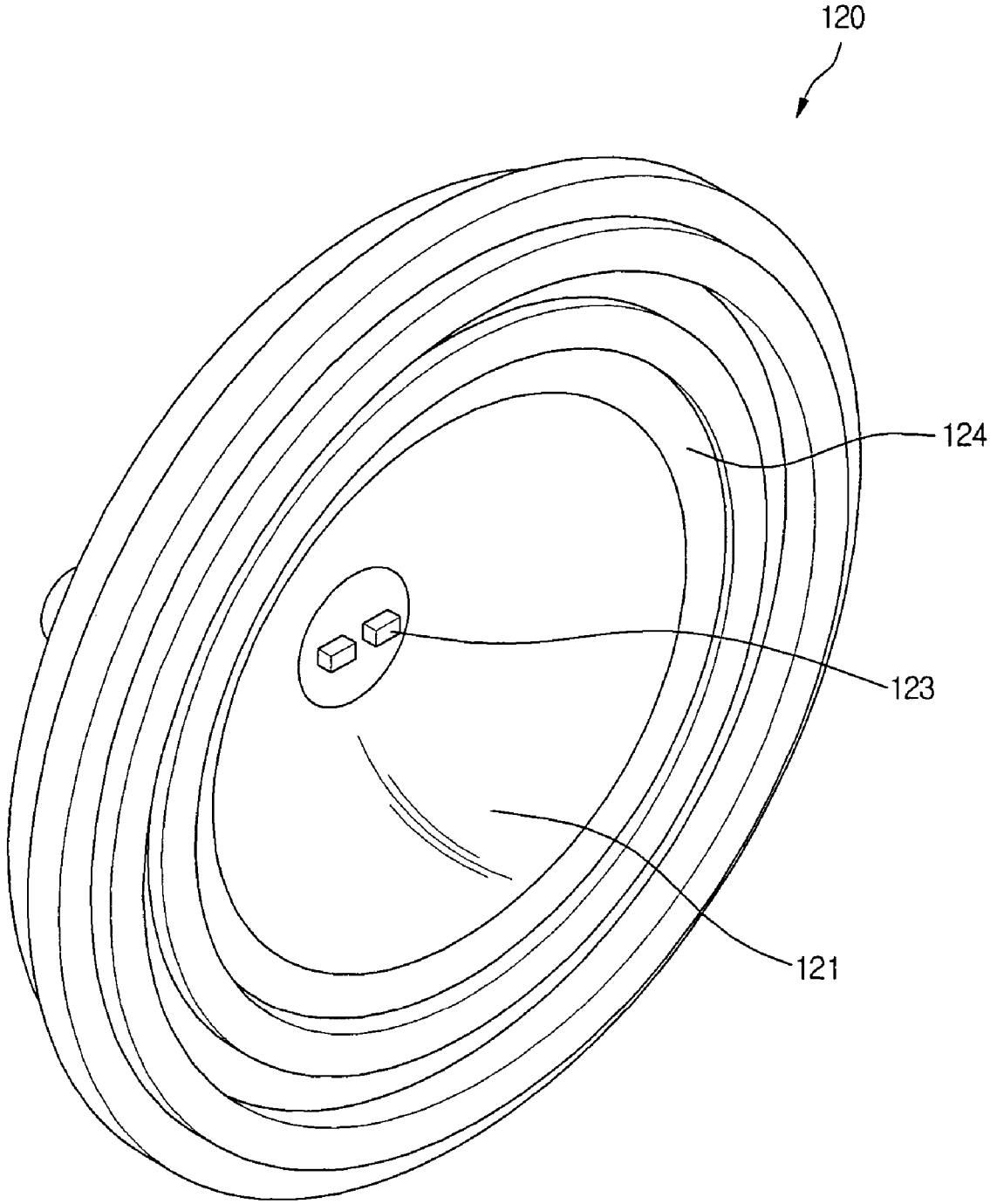
FIG. 5 is a front perspective view of the supporting holder in FIG. 4.

FIG. 4 is a rear perspective view of a supporting holder for a drum supporting portion according to the present invention, and FIG. 5 is a front perspective view of the supporting holder in FIG. 4.

Referring to FIGS. 4 and 5, a supporting holder 120 according to the present invention is mounted on top of the housing 110 and formed of molded plastic.

In detail, the supporting holder 120 includes a ball mounting portion 121 concaved a predetermined depth in an inner portion thereof for mounting the bearing 130, a pair of agitating protrusions 123 protruding from the floor of the ball mounting portion 121, and one or more guide bosses 122 protruding a predetermined interval apart from each other on the rear perimeter thereof.

In further detail, the bottom surface of the ball mounting portion 121 is mounted to the supporting holder mounting portion 117 of the housing 110, and the upper surface is mounted to the bearing 130. Lubricant collects on the floor of the ball mounting portion 121. A predetermined gap is formed between the end portions of the ball mounting portion 121 and the bearing 130, and lubricant collects in this gap. The agitating protrusions 123 formed on the floor of the ball mounting portion 121 agitate the lubricant when the bearing 130 rotates to evenly distribute lubricant to the outer circumference of the bearing 130. Here the size and shape of the agitating protrusion 123 are not limited to those described in this embodiment, and may adopt any configuration that is able to agitate lubricant. Also, a sealing member mounting surface 124 with a predetermined width is formed on the perimeter of the ball mounting portion 121. A sealing member 150 is mounted on the sealing member mounting surface 124 to prevent leakage of lubricant applied to the surface of the ball mounting portion 121.

The guide bosses 122 protruding from the rear surface of the supporting holder 120 insert into the guide boss insert holes 115 of the housing 110. Thus, the supporting holder 120 is fixed by the guide bosses 122 to the housing 110.

After the supporting holder 120 is formed by injection molding, the floor of the ball mounting portion 121 undergoes a finishing process. In detail, the finishing processing polishes the floor surface of the ball mounting portion 121 so that the floor is smoothened. Accordingly, friction is minimized when the bearing 130 is mounted and rotates on the floor surface of the ball mounting portion 121.

Figure 6:
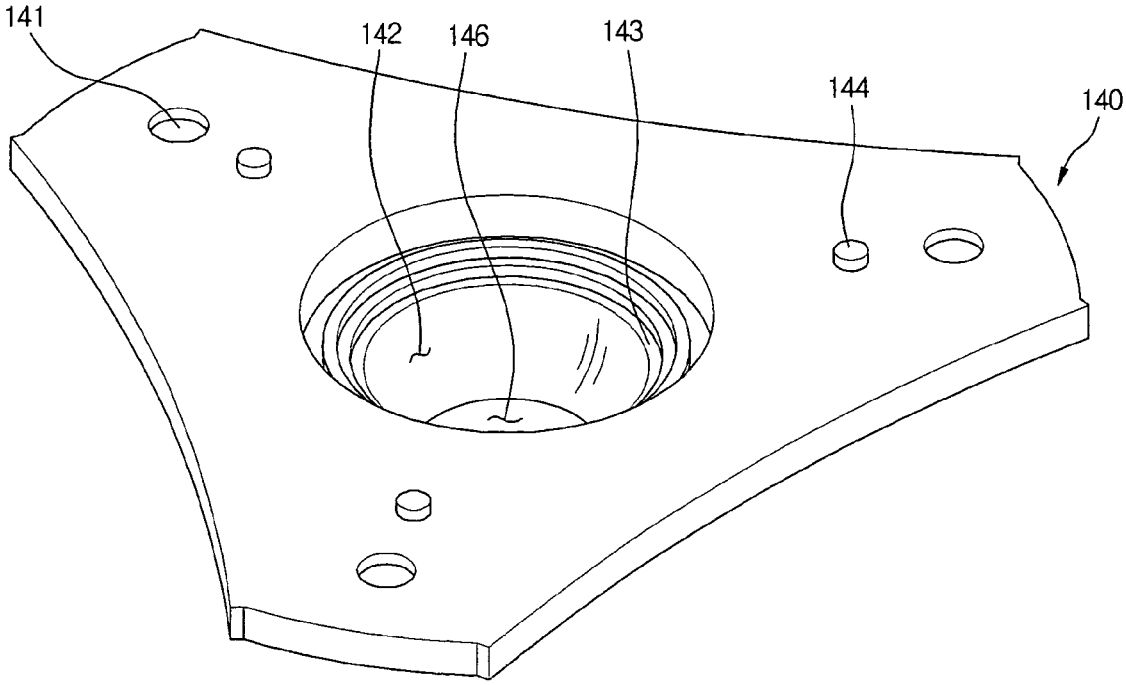
FIG. 6 is a front perspective view of a housing cover according to the present invention.
Figure 7:
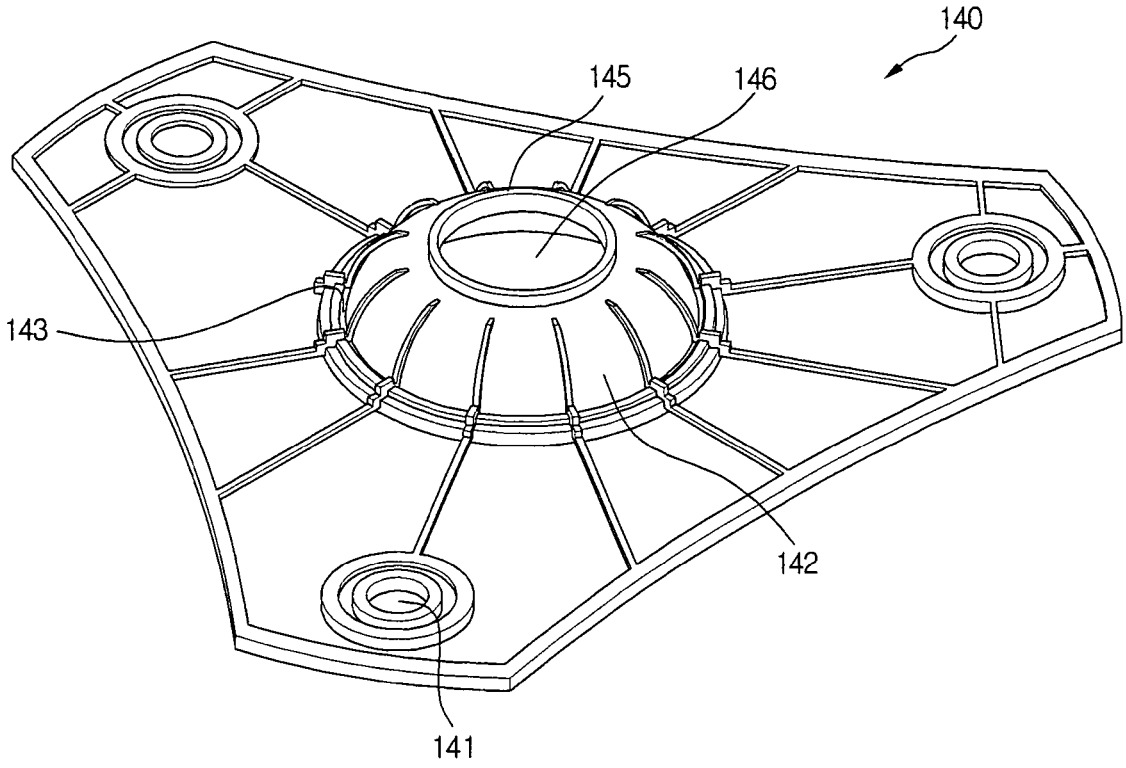
FIG. 7 is a rear perspective view of the housing cover in FIG. 6.

FIG. 6 is a front perspective view of a housing cover according to the present invention, and FIG. 7 is a rear perspective view of the housing cover in FIG. 6.

Referring to FIGS. 6 and 7, a housing cover 140 according to the present invention forms a roughly triangular shape, and the three pointed ends are tightly coupled to the housing cover mounting portion 112 of the housing 110. However, the shape of the housing cover 140 is not limited to that of this embodiment, and may be formed in a multi-angled or a circular shape.

In detail, the housing cover 140 includes a ball receptacle 142 recessed a predetermined depth within for covering the upper surface of the ball of the bearing 130, a shaft through-hole 146 formed at the center of the ball receptacle 142 for inserting the shaft of the bearing 130 therethrough, and a sealing member mounting surface 143 formed with a predetermined width at the perimeter of the ball receptacle 142 for mounting the sealing member 150 on.

In more detail, the shaft through-hole 146 includes a cylindrical through-sleeve 145 that extends with a predetermined diameter and distance from the center of the ball receptacle 142. The sealing member 150 is inserted in a space formed between the sealing member mounting surface 143 and the sealing member mounting surface 124 formed within the supporting holder 120. That is, the sealing member 150 is pressed on either side by the housing cover 140 and the supporting holder 120.

Preliminary fastening protrusions 144 are formed to protrude a predetermined distance respectively from the three end portions of the housing cover 140, and housing fastening holes 141 are respectively formed a predetermined distance from the preliminary fastening protrusions 144.

Specifically, the preliminary fastening protrusions 144 insert into the preliminary fastening holes 114 formed in the housing cover mounting portion 112 of the housing 110. Fastening members are inserted through the housing fastening holes 141 and the housing cover fastening holes 113 of the housing 110 to couple the housing cover 140 and the housing 110.

Figure 8:
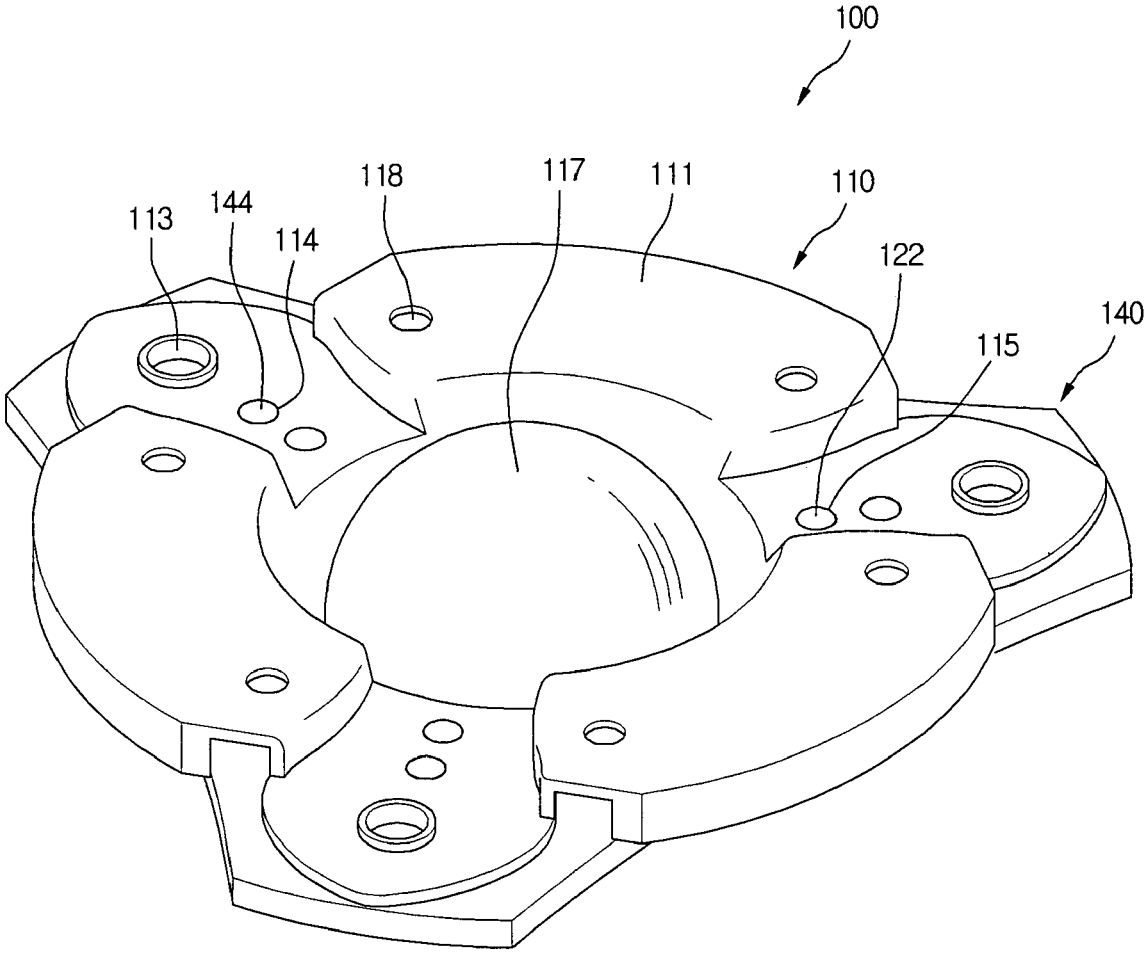
FIG. 8 is a perspective view showing a drum supporting portion according to the present invention in an assembled state.

FIG. 8 is a perspective view showing a drum supporting portion according to the present invention in an assembled state.

Referring to FIG. 8, the drum supporting portion 100 according to the present invention includes a housing 110 installed on a rear surface of the drum, a housing cover 140 coupled to the housing 110, a supporting holder 120 installed between the housing 110 and the housing cover 140, and a bearing 130 and a sealing member 150.

As shown in FIG. 8, a fastening protrusion 144 of the housing cover 140 is inserted in the preliminary fastening hole 114 formed in the housing cover mounting portion 112 of the housing 110. The guide boss 122 protruding from the rear surface of the supporting holder 120 is inserted in the guide boss insert hole 115. A fastening member is inserted in the drum fastening hole 118 to fix the drum supporting portion 100 to the rear surface of the drum. The fastening member inserts through the housing cover fastening hole 113 to couple the housing cover 140 to the housing 110.

Figure 9:
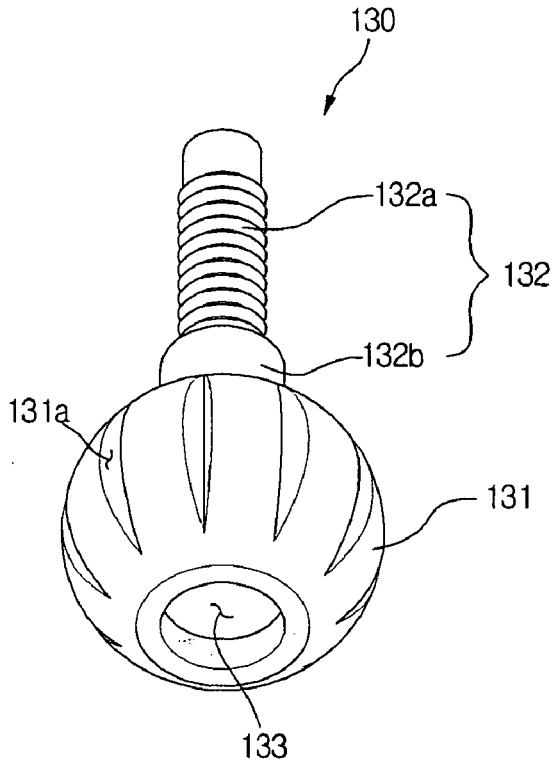
FIG. 9 is a perspective view of a bearing according to the present invention.

FIG. 9 is a perspective view of a bearing according to the present invention.

Referring to FIG. 9, the bearing 130 according to the present invention includes a ball 131 and a shaft 132 that inserts through the center of the ball 131.

In detail, oil grooves 131*a* are recessed a predetermined depth vertically around the outer edge of the ball 131 to allow lubricant to flow. The bottom end of the ball 131 has a flat surface cut perpendicularly to the shaft 132. The end of the shaft 132 is disposed a predetermined depth inward from the cut surface. An oil holding hole 133 is formed inward from the cut surface to the end of the shaft 132, so that lubricant can collect in the oil holding hole 133. The agitating protrusions 123 formed on the floor of the supporting holder are disposed within the oil holding hole 133. Accordingly, when the drum rotates, the agitating protrusions 123 rotate with the drum and agitate the oil in the oil holding hole 133 to apply it evenly on the outer surface of the ball 131.

The shaft 132 includes a ball supporting portion 132*b* extending a predetermined distance from the outer surface of the ball 131, and a screw 132*a* extending a predetermined distance further from the ball supporting portion 132*b*. The ball supporting portion 132*b* inserts through the through-sleeve 145, so that the bearing 130 is supported by the through-sleeve 145.

In more detail, the ball supporting portion 132*b* is partially inserted into the ball 131, and the portion thereof extending outward from the ball 131 inserts through the shaft through-hole 146 of the housing cover 140. The outer diameter of the ball supporting portion 132*b* is formed to be the same as the inner diameter of the shaft through-hole 146, so that the lubricant in the housing cover 140 does not leak outside. The sealing cap 180 covers the outer surface of the ball supporting portion 132*b* to doubly prevent leaking of lubricant. The gasket 170 is mounted on the upper surface of the ball supporting portion 132*b*. Also, the back cover is positioned on the upper surface of the gasket 170, and a nut 190 is inserted over the outer surface of the screw 132*a*. That is the nut 190 is tightened to firmly assemble the ball supporting portion 132*b*, the gasket 170, and the back cover.

Here, the ball 131 and the shaft 132 forming the bearing 130 may be integrally formed using an insert injection molding process.

Figure 10:
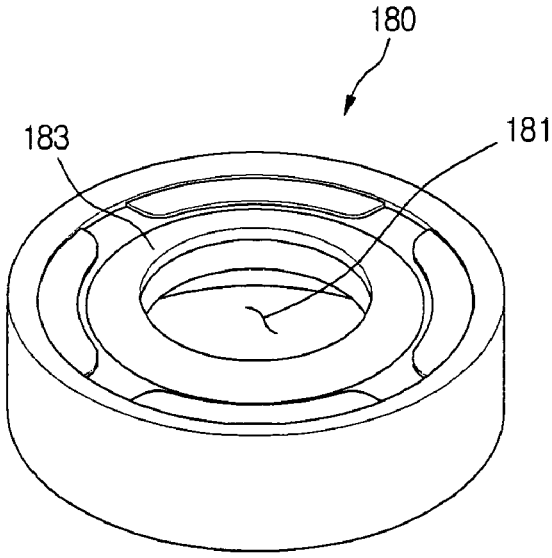
FIG. 10 is a front perspective view of a sealing cap according to the present invention.
Figure 11:
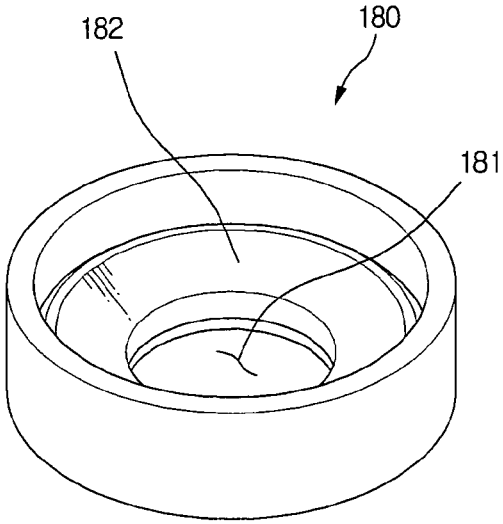
FIG. 11 is a rear perspective view of the sealing cap in FIG. 10.

FIG. 10 is a front perspective view of a sealing cap according to the present invention, and FIG. 11 is a rear perspective view of the sealing cap in FIG. 10.

Referring to FIGS. 10 and 11, a sealing cap 180 according to the present invention covers the upper portion of the ball supporting portion 132*b* of the bearing 130, as described above.

In detail, the sealing cap 180 has a rubber sealing member insert molded to a cylindrical metal piece. Accordingly, by forming the cylindrical portion of the sealing cap 180 from metal, it is not worn by vibrations caused by the rotation of the drum. Also, by covering the cylindrical portion with rubber, the lubricant filled inside the drum supporting portion 100 does not leak to the outside.

A shaft through-hole 181 of a predetermined diameter is formed in the center of the floor of the sealing cap 180, and two or more lips are formed around the edges of the shaft through-hole 181. The lips prevent leaking of the lubricant through the shaft through-hole 181.

In detail, the shaft 132 of the bearing 130 passes through the shaft through-hole 181, and the outer diameter of the shaft 132 may be formed the same as the inner diameter of the shaft through-hole 181. The lip forms an inner lip 182 and an outer lip 183, such that a slight gap is formed between the inner and outer lips 182 and 183. Accordingly, when the drum rotates, the end portion of the inner lip 182 can move flexibly to prevent lubricant from leaking along the outer surface of the shaft 132.

Figure 12:
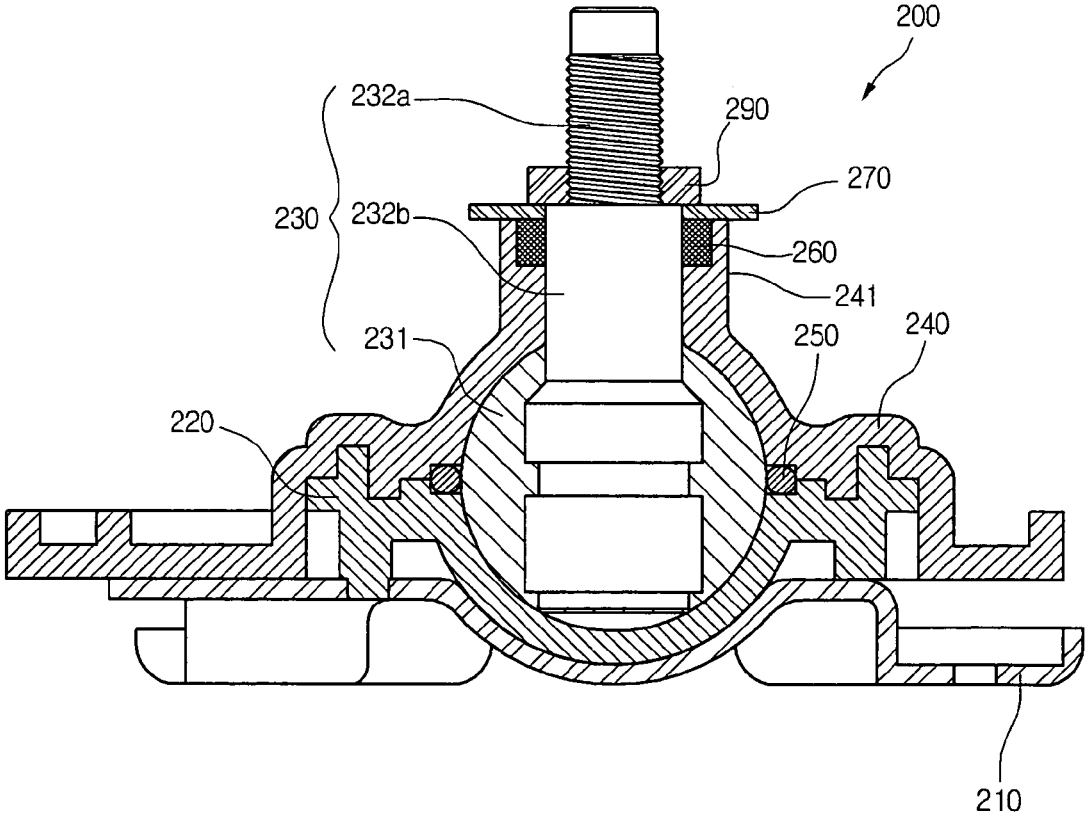
FIG. 12 is a sectional view of a drum supporting portion according to another embodiment of the present invention.

FIG. 12 is a sectional view of a drum supporting portion according to another embodiment of the present invention.

Referring to FIG. 12, a drum supporting portion 200 according to the present invention includes a housing 210, a housing cover 240 coupled to the housing 210, a supporting holder 220 mounted within the housing 210, a bearing 230 mounted within the supporting holder 220, a first sealing member 250 encircling the portion at which the supporting holder 220 and the housing cover 240 meet, a gasket 270 mounted on an upper surface of the housing cover 240, and a nut 290 coupled on the upper surface of the gasket 270. The components described above are the same as those in the embodiment shown in FIG. 1.

The bearing 230 includes a ball 231 and a shaft 232. A portion of the shaft 232 inserts into the ball 231 and another portion thereof protrudes out from the ball 231. That is, the shaft 232 includes a ball supporting portion 232*b* protruding outward from the ball 231, and a screw 232*a* extending a predetermined distance from the ball supporting portion 232*b*. These components are also the same as the embodiment shown in FIG. 1.

However, the shape of the through-hole portion of the housing cover 240 through which the shaft 232 passes is different from the embodiment shown in FIG. 1.

In detail, in order to receive the upper surface of the ball 231, the inside of the housing cover 240 is recessed a predetermined depth. Also, a shaft supporting portion 241 extends a predetermined distance at the center of the recessed portion, and the shaft 232 passes through the shaft supporting portion 241. A second sealing member 260 is provided on the inner end of the shaft supporting portion 241 to prevent leaking of lubricant.

In further detail, a stepped mounting portion is formed for mounting the second sealing member 260 at the inner end of the shaft supporting portion 241. The second sealing member 260 is shaped as a circular belt, and the shaft 232 passes through its inside. Thus, the inner surface of the second sealing member 260 is sealed against the outer surface of the shaft 232, and its outer surface is pressed against the inner surface of the shaft supporting portion 241. Here, felt may be used as a material for the second sealing member 260, in order to minimize frictional heat produced from rubbing with the shaft 232, while at the same time preventing leaking of lubricant.

By employing a first sealing member 250 inserted between the housing cover 240 and the housing 210, and a second sealing member 260 inserted in the shaft supporting portion 241, the above-structured drum supporting portion 100 according to the present invention prevents leakage of lubricant in two stages. Additionally, the manufacturing cost of the second sealing member 260 can be reduced to reduce the overall manufacturing cost of the drum supporting portion 200.

Also, by using a felt material for the second sealing member 260, the sealing area becomes wider for improved sealing results.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dryer comprising:

a housing coupled to a rear wall of a drum;

a housing cover coupled to the housing;

a bearing interposed between the housing and the housing cover; and a supporting holder interposed between the housing and the bearing, the supporting holder comprising one or more agitating protrusions which protrude from an inner surface of the supporting holder, wherein the bearing comprises a shaft extending from a ball, and wherein a space is configured to accommodate the agitating protrusion between the supporting holder and the ball.

2. The dryer according to claim 1, wherein the supporting holder is formed of injection molded plastic.

3. The dryer according to claim 1, wherein the supporting holder includes a central portion recessed a predetermined depth for the bearing to firmly press against.

4. The dryer according to claim 1, wherein the supporting holder is more smoothly finished on a surface thereof that contacts the bearing than on other surfaces thereof.

5. The dryer according to claim 1, further comprising a sealing member inserted in a contacting portion between the housing and the housing cover.

6. The dryer according to claim 1, further comprising a sealing member coupled to an end of the housing cover through which the bearing passes, the sealing member for preventing leakage of lubricant.

7. The dryer according to claim 6, wherein the sealing member is formed of insert injection molded rubber and metal or a felt material.

8. The dryer according to claim 1, wherein the supporting holder has a concave surface coupled to a complementary concave surface of the housing with a first sealing member between the supporting holder and housing, and wherein the housing contacts an exterior surface of the rear wall of the drum and has a surface that contacts and substantially conforms to the concavity of the supporting holder.

9. The dryer according to claim 8, wherein the housing, housing cover, bearing, and supporting holder are located outside of the drum.

10. The dryer according to claim 9, wherein the concave surface of the supporting holder is a continuous surface with no openings, and wherein the ball is spaced from and enclosed between the concave surface of the housing, the continuous concave surface of the supporting holder, and the first sealing member.

11. The dryer according to claim 10, wherein the one or more agitating protrusions are arranged to move lubricant around the ball when the drum is rotated, the lubricant enclosed between the concave surface of the housing, the continuous concave surface of the supporting holder, and the first sealing member.

12. The dryer according to claim 11, further comprising:

a second sealing member disposed around the shaft connected to the ball.

13. The dryer according to claim 11, further comprising:

a plurality of guide bosses extending from the supporting holder, wherein the bosses are disposed circumferentially around the concave surface of supporting holder in a direction opposite to a direction in which the one or more agitating protrusions extend, the bosses coupled to respective holes in the housing for allowing the supporting holder to rotate with the housing when the drum is rotated.

* * * * *